US007100781B2

(12) United States Patent
Craft

(10) Patent No.: US 7,100,781 B2
(45) Date of Patent: Sep. 5, 2006

(54) ADJUSTABLE SHELF SYSTEM

(75) Inventor: Charles William Craft, Apple Creek, OH (US)

(73) Assignee: Rubbermaid Incorporated, Wooster, OH (US)

( * ) Notice: Subject to any disclaimer, the term of this patent is extended or adjusted under 35 U.S.C. 154(b) by 187 days.

(21) Appl. No.: 10/732,431

(22) Filed: Dec. 10, 2003

(65) Prior Publication Data

US 2004/0159623 A1 Aug. 19, 2004

Related U.S. Application Data

(60) Provisional application No. 60/434,469, filed on Dec. 18, 2002.

(51) Int. Cl.
*A47B 45/00* (2006.01)

(52) U.S. Cl. ..... 211/187; 108/147.13; 108/156

(58) Field of Classification Search ..... 211/187, 211/103, 190, 207; 108/107, 147.13, 156
See application file for complete search history.

(56) References Cited

U.S. PATENT DOCUMENTS 3,604,369 A * 9/1971 Maslow ..... 108/147.13
4,237,798 A * 12/1980 Welsch et al. ..... 108/192
4,627,543 A * 12/1986 Nicely ..... 211/187
4,637,323 A * 1/1987 Nicely ..... 108/107
4,750,626 A * 6/1988 Nicely ..... 211/187
4,754,712 A * 7/1988 Olson et al. ..... 108/107
4,763,799 A * 8/1988 Cohn et al. ..... 211/187
4,799,818 A * 1/1989 Sudimak et al. ..... 403/107
5,127,342 A * 7/1992 Taylor ..... 108/147.13
2002/0046982 A1* 4/2002 Guizzardi ..... 211/187
2005/0199160 A1* 9/2005 Ching-Po ..... 108/107

* cited by examiner

*Primary Examiner*—Richard E. Chilcot, Jr.
*Assistant Examiner*—James Dooley
(74) *Attorney, Agent, or Firm*—Marshall, Gerstein & Borun LLP

(57) ABSTRACT

An adjustable shelving system is disclosed wherein each support post includes a plurality of slots based vertically along the support post. The shelving system also includes one or more collars slidably received over the support post. The collars include cleats which are received in the slots to secure the collar in a vertical position. To disengage the collar or cleat of the collar from a slot, the collar is slid upwards thereby releasing the cleat of the collar from the slot then, upon rotation of the collar, the collar can be slid axially along the support post to a new, desired location. Then, with the cleat of the collar disposed slightly vertically above a new desired slot, the collar is rotated back so that the cleat is in alignment with the slot and then slid downward to engage the cleat in the new slot at the new, desired location. The collar either directly or indirectly supports a shelf. Thus, an adjustable shelving system is disclosed that requires no hand tools when adjusting the vertical position of the one or more shelves.

28 Claims, 5 Drawing Sheets

ADJUSTABLE SHELF SYSTEM

CROSS-REFERENCE TO RELATED APPLICATION

This application claims the benefit under 35 U.S.C. § 119(e) of U.S. provisional patent application Ser. No. 60/434,469 filed Dec. 18, 2002, the disclosure of which is incorporated herein by reference.

TECHNICAL FIELD

An adjustable shelving system is disclosed. More specifically, an adjustable shelving system is disclosed wherein collars are used to directly or indirectly support a shelf are slidably received on cylindrical support posts. The support posts include slots or grooves spaced axially along the support post. The slots accommodate a cleat disposed on an inner surface of the collar. To adjust the height of a collar, and therefore a shelf, the cleat, and therefore the collar, may be easily disengaged from a slot by simply applying upward pressure on the collar which results in easy disengagement of the cleat from the slot due to the design of both components. The collar is then rotated slightly and slid along the support post until the collar is disposed slightly above the next desired slot. The collar is then rotated until the cleat is in alignment with the desired slot and slid downward resulting in engagement of the cleat in the slot. The shelf and/or other supporting apparatus may then be replaced.

BACKGROUND OF THE RELATED ART

Adjust shelving systems are known. This disclosure is directed toward freestanding shelving systems with elongated cylindrical support posts. The support posts are equipped with a plurality of collars fastened or secured to the support post at discreet vertical locations. The collars then either directly or indirectly support a shelf.

With previous designs, in order to adjust the vertical position of a shelf, the shelf must first be removed or freed from the collars, typically by applying upward force to the shelf with a first or mallet. Then, to adjust the position of the collars, the collars must either by pried away from the support post using a screw driver or other prying tool before the collar can be relocated to the next desired position. Other collars are secured to the support posts with a plurality of pins. The pins must be removed with a pair of pliers or other suitable tool.

Thus, in the currently available designs, hand tools in the form of mallets, screw drivers, other prying tools and/or pliers are required to adjust the position of the shelf. Further, because the designs of the previous collars require a substantial amount of force or strength to make vertical adjustments, the adjustment procedure is cumbersome due to the fact that there are at least four collars and four support posts to support a single shelf. Thus, the cumbersome procedure used to adjust the vertical position of a collar must be repeated four times.

Accordingly, there is a need for an improved freestanding adjustable shelving system which provides for faster and easier shelf height adjustment and without the need for hand tools or other special tools.

SUMMARY OF THE DISCLOSURE

An adjustable shelving system is disclosed which comprises a collar and a cylindrical support post. The support post comprises at least two slots disposed on an outer surface thereof and spaced axially along the support post. Each slot comprises a lower horizontal surface that extends through the outer surface of the support post a first depth. Each slot extends upward from its lower horizontal surface and tapers outward to the outer surface of the support post so that an upper distal end of each slot is at least substantially flush with the outer surface of the support post.

The collar comprising a cylindrical body slidably received over the support post. The collar extends substantially around the support post and terminates in two free ends with a gap disposed therebetween. The body of the collar further comprises a radially outwardly extending flange and a radially inwardly extending cleat. The cleat of the collar is received in one of the slots of the support post so that the cleat engages the lower horizontal surface of one of the slots thereby providing vertical support for the collar and a shelf. The collar is movable along the support post by applying upward pressure on the collar to slide the cleat upwards off of the lower horizontal surface of the slot and past the distal end of the slot.

In a refinement, the cleat comprises a lower horizontal end that extends radially inwardly from the body of the collar a first distance less than or equal to the first depth of each lower horizontal surface of each slot.

In a refinement, the cleat further comprises an inner surface the extends upward from the lower horizontal surface of the cleat to an upper distal end that is at least substantially flush with an inner surface of the body of the collar.

In a refinement, each slot further comprises an inner wall extending from the lower horizontal surface to the upper distal end of the slot. In this refinement, the inner wall is concave.

In a refinement, the cleat comprises a lower horizontal end that extends radially inwardly from the body of the collar and an inner surface that extends upward from the lower horizontal surface of the cleat to an upper distal end that is at least substantially flush with an inner surface of the body of the collar. In this refinement, the inner surface of the cleat is convex so that it mateably engages the concave inner wall of the slot in the support post as discussed above.

In a refinement, the shelving system further comprises a end cap that surrounds the body of the collar and that is supported by the flange of the collar and a shelf is supported by the end cap. In this refinement, the end cap comprises a annular body with a central opening received over the body of the collar and a lower end that is supported by the flange of the collar. The body of the end cap is connected to a horizontal body with an opening for receiving the shelf.

In a refinement, the support post comprises at least two pairs of slots vertically spaced apart along the support post, each slot is disposed diametrically opposite the support post from the other slot of its respective pair. The collar further comprises a pair of cleats. Each cleat is disposed diametrically opposite the body of the collar from the other cleat mounted on each of four support posts. In a refinement, each collar supports an end cap as described above and the end caps are used to accommodate or support a shelf.

In a further refinement, the annular bodies of two end caps can be connected to a single horizontal body that extends between front and rear support posts. Thus, a four support post system with four collars and four end caps may include only two horizontal bodies with opposing openings that extend from front to rear end posts. The shelf may then be easily slide into the openings of the horizontal bodies after the vertical adjustment has been made.

In another refinement, the support post may further comprise end caps or collars that are not adjustable. In such a refinement, a horizontal groove may be disposed around the support post which receives a radially inwardly extending rib disposed on an inner surface of an end cap or collar to thereby fix the end cap or collar in place. This refinement would be particularly suitable for a top shelf and/or a bottom shelf where no vertical adjustment is desired.

A method for adjusting the vertical height of a shelf is also disclosed wherein the shelf is first removed from engagement with a collar and/or end cap. The end cap is then slid upward to release the cleat from engagement with the slot. The collar is then rotated, less than one full rotation or 360°, preferably about 10°, and then the collar can be moved vertically to a point where the cleat and/or collar is disposed slightly vertically above the desired slot. The collar is then rotated back so the cleat is in alignment with the slot and then slide downward to engage the cleat in the slot. The end cap and/or shelf may then be replaced.

BRIEF DESCRIPTION OF THE DRAWINGS

The disclosed apparatuses and methods are described more or less diagrammatically in the accompanying drawings wherein.

It should be understood that the drawings are not necessarily to scale and that the embodiments are illustrated by phantom lines, diagrammatic representations and fragmentary views. In certain instances, details which are not necessary for an understanding of the disclosed apparatuses and method or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
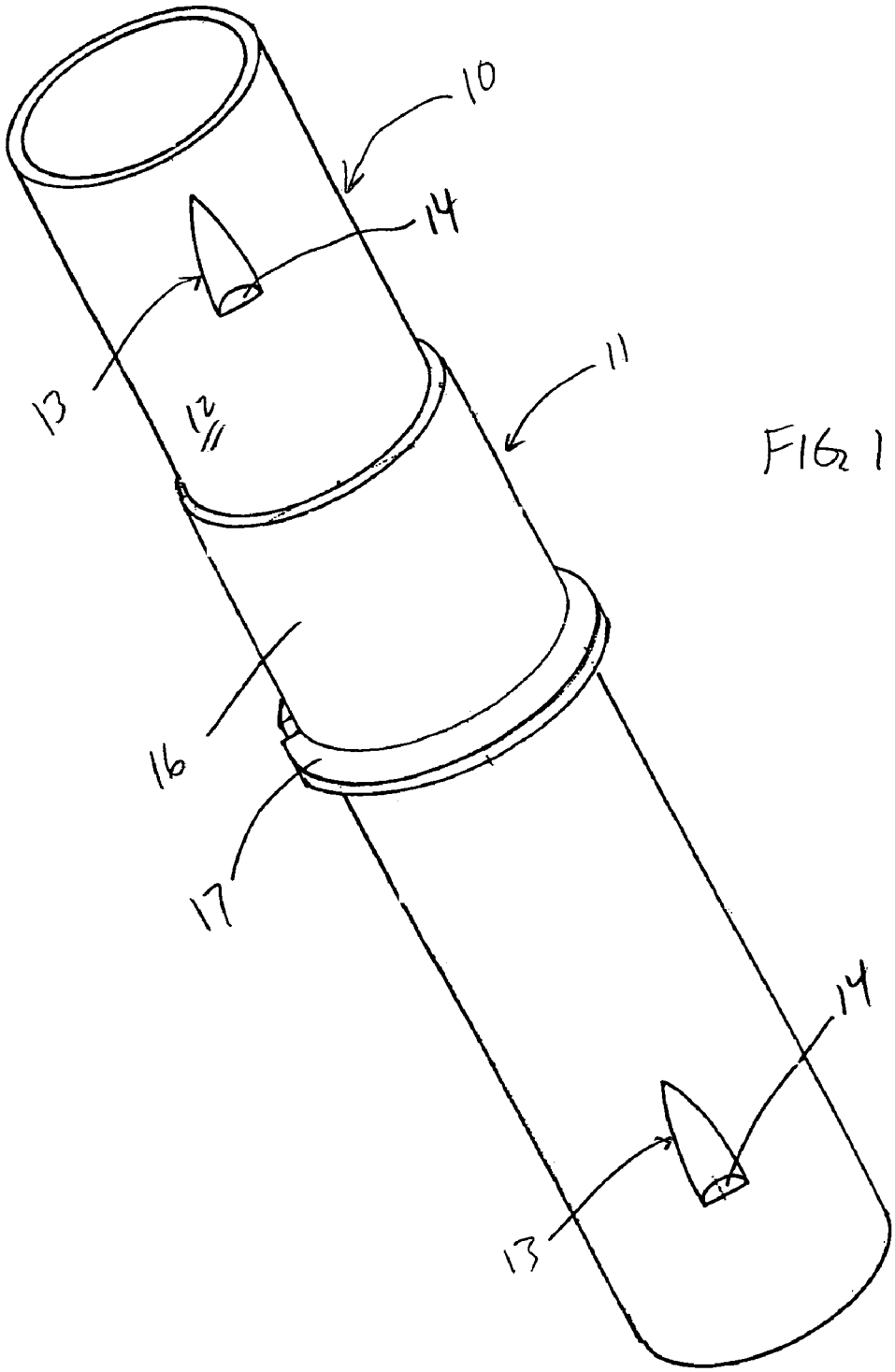
FIG. 1 is a partial perspective view of a support post and an adjustable collar.

FIG. 1 is a perspective view of a support post 10 and collar 11. The support post 10 includes an outer surface 12 that includes a plurality of slots 13. Each slot 13 includes a lower horizontal surface 14 that supports a cleat 15 (see FIG. 2) disposed on an inner surface of the collar 11. The collar 11 also includes a cylindrical body 16 connected to a radially outwardly extending flange 17 at its lower end. The flange 17 is used to support an end cap 18 or a shelf 19 (see FIG. 4).

Figure 2:
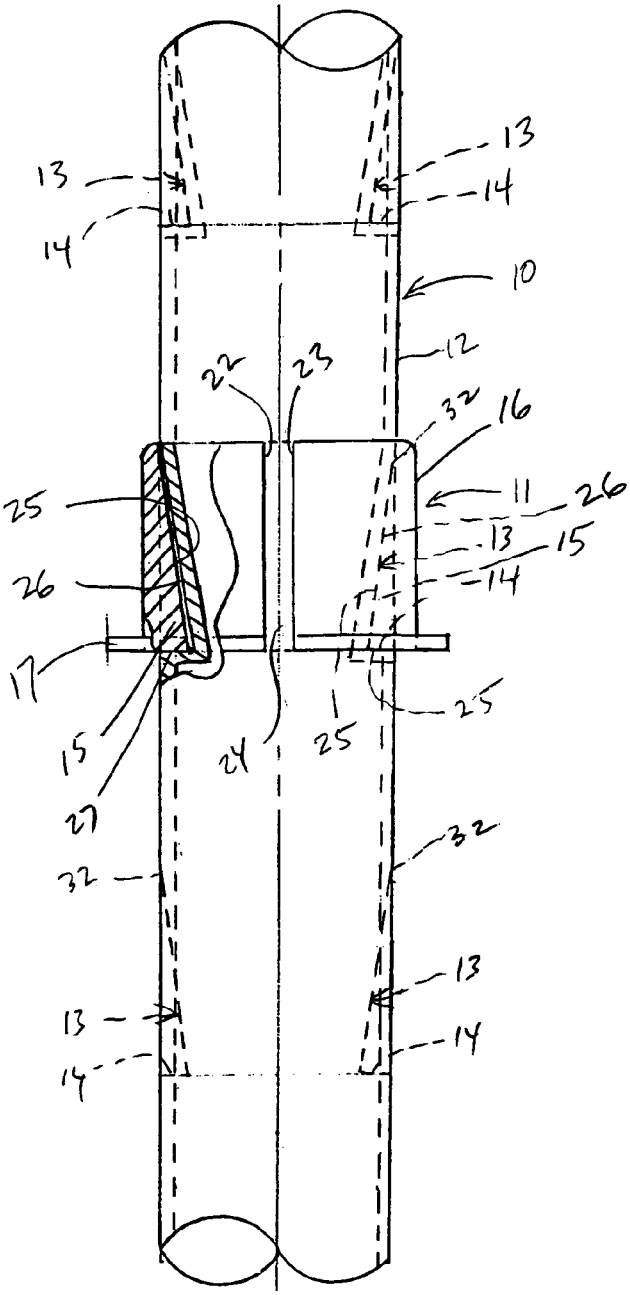
FIG. 2 is a partial plan and sectional view of the support post and collar of FIG. 1.

Turning to FIG. 2, in the embodiment of the support post 10 shown, the support post 10 includes three pairs of slots 13. Each pair of slots 13 are disposed diametrically opposite the support post 10 from one another as shown. Consequently, the collar 11 also includes two cleats 15, also disposed diametrically opposite one another on the body 16 of the collar 11. The body 16 of the collar 11 is not completely cylindrical, but includes free ends 22, 23 with a gap 24 disposed therebetween. As a result, when removing the collar 11 from the slots 13 as shown in FIG. 2 to either slots 13 disposed above or below the position shown in FIG. 2, the collar 11 can be pushed upward allowing the inner surfaces 25 of the cleats 15 to slide against the inner walls 26 of the slots 13 and, as this happens, the collar 11 expands radially outwardly thereby enlarging the gap 24 or the distance between the free ends 22, 23. It will also be noted that the collar 11, in the position shown in FIG. 2, is supported by engagement of the lower horizontal surfaces 27 of the cleats 15 against the lower horizontal surfaces 14 of the slots 13.

Figure 3:
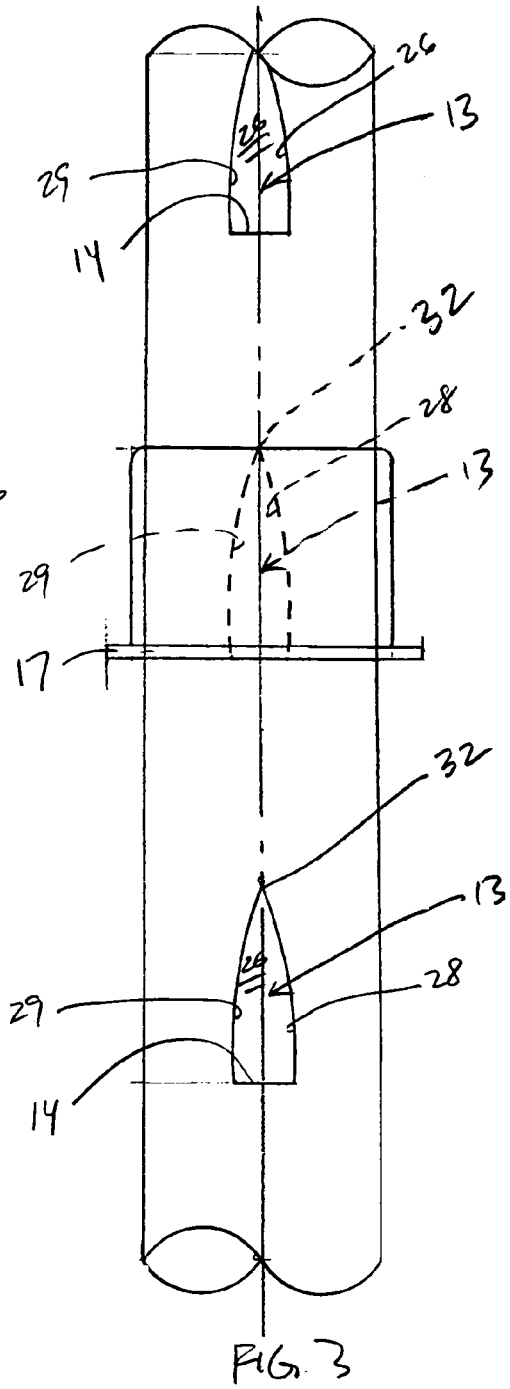
FIG. 3 is a partial plan view of the support post and collar of FIG. 1.

Turning to FIG. 3, in the embodiment disclosed, the slots 13 are shown with convex inner walls 26. As the convex inner wall 26 extends upward from the lower horizontal surface 14, the side edges 28, 29 extend toward each other and terminate at an upper distal end 32 that, as shown in FIG. 2, is flush with or substantially flush with the outer surface 12 of the support post 10.

Figure 4:
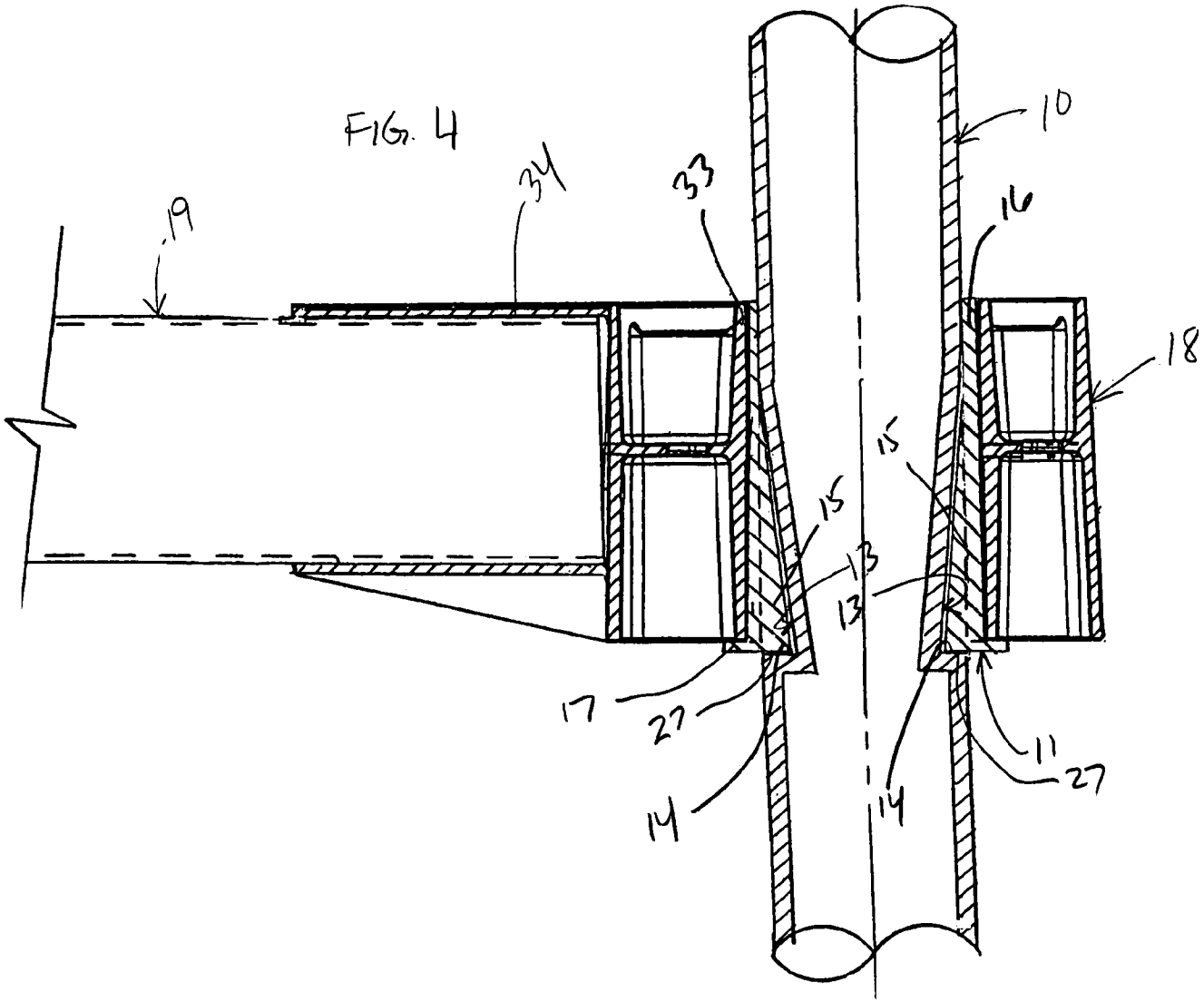
FIG. 4 is a partial sectional view of a support post, collar, end cap and shelf of the disclosed adjustable shelving system.

Turning to FIG. 4, an end cap 18 and shelf 19 are also illustrated with a support post 10 and collar 11. As shown in FIG. 4, the collar 11 is secured in place on the support post 10 by engagement of the cleats 15 in the slots 13. The lower horizontal surfaces 27 of the cleats 15 engage and are supported by the lower horizontal surfaces 14 of the slots 13. The body 16 of the collar 11 is disposed within a cylindrical opening of the end cap 18. The end cap 18 is supported by the lower radially outwardly extending flange 17 of the collar 11. The end cap 18 includes an essentially cylindrical body 33 that is connected to a horizontal body 34. The horizontal body 34 of the end cap 18 includes a horizontal opening which accommodates the shelf 19 as shown.

As noted above, for a freestanding four support post shelf system, separate end caps 18 may be utilized for each collar 11. However, the cylindrical bodies 13 of each end cap 18 may, consequently, be connected to another end cap 18 by a horizontal body 34 that extends between end caps. Thus, two end caps 18 may "share" a horizontal body 34 and, to insert a shelf 19 in place, the shelf 19 would be slide along with inner cavity provided by the horizontal body 34.

Figure 5:
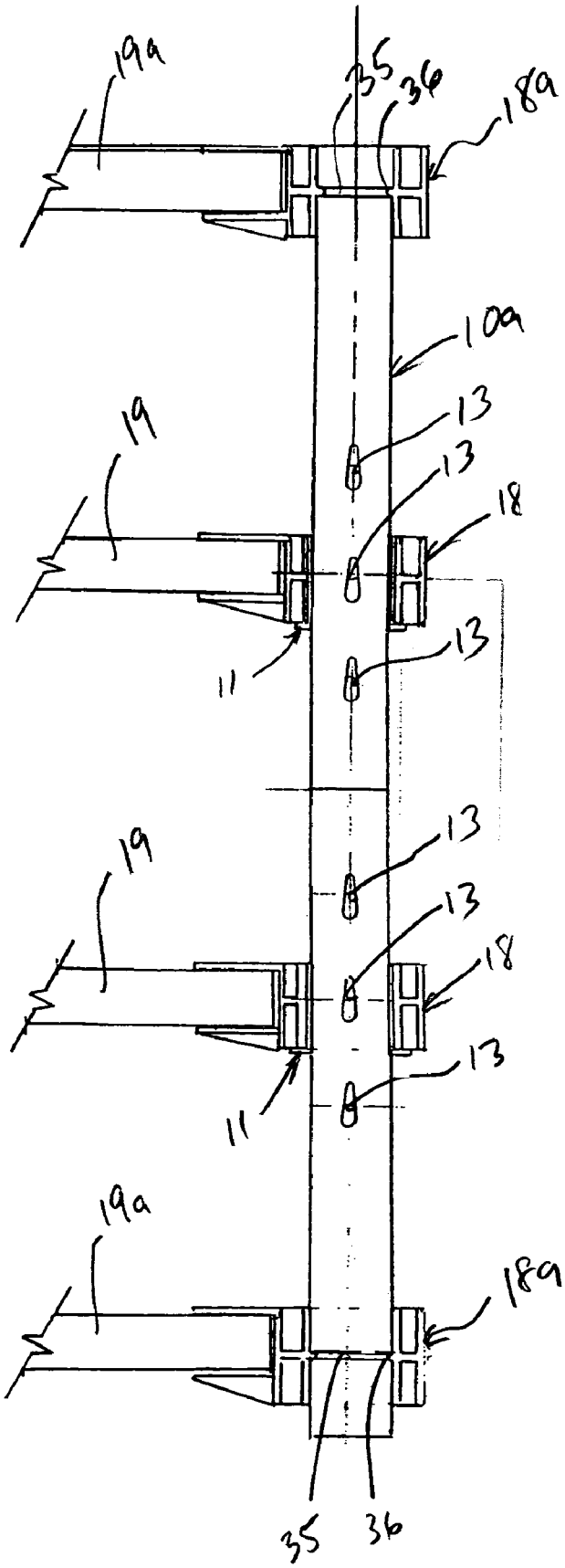
FIG. 5 is a partial plan and sectional view of a support post, two non-adjustable end caps and shelves and two adjustable collars, end caps and shelves of one disclosed adjustable shelving system.

Turning to FIG. 5, a support post 10*a* is illustrated with non-adjustable shelves 19*a* and adjustable shelves 19. Specifically, circumferential grooves 35 are disposed at the upper and lower ends of the support post 10*a*. These grooves 35 accommodate a radially inwardly extending rib 36 of the modified end caps 18*a*. In this variation, no collar 11 is required. The support post 10*a* supports the end caps 18*a* which, in turn, support the shelves 19*a* as shown in FIG. 5. In contrast, the middle shelves shown at 19 are adjustable as they are supported by collars 11 and end caps 18 as discussed above and the support post 10*a* includes a plurality of slots 13 to adjust the vertical spacing of the shelves 19 as discussed above.

Figure 6:
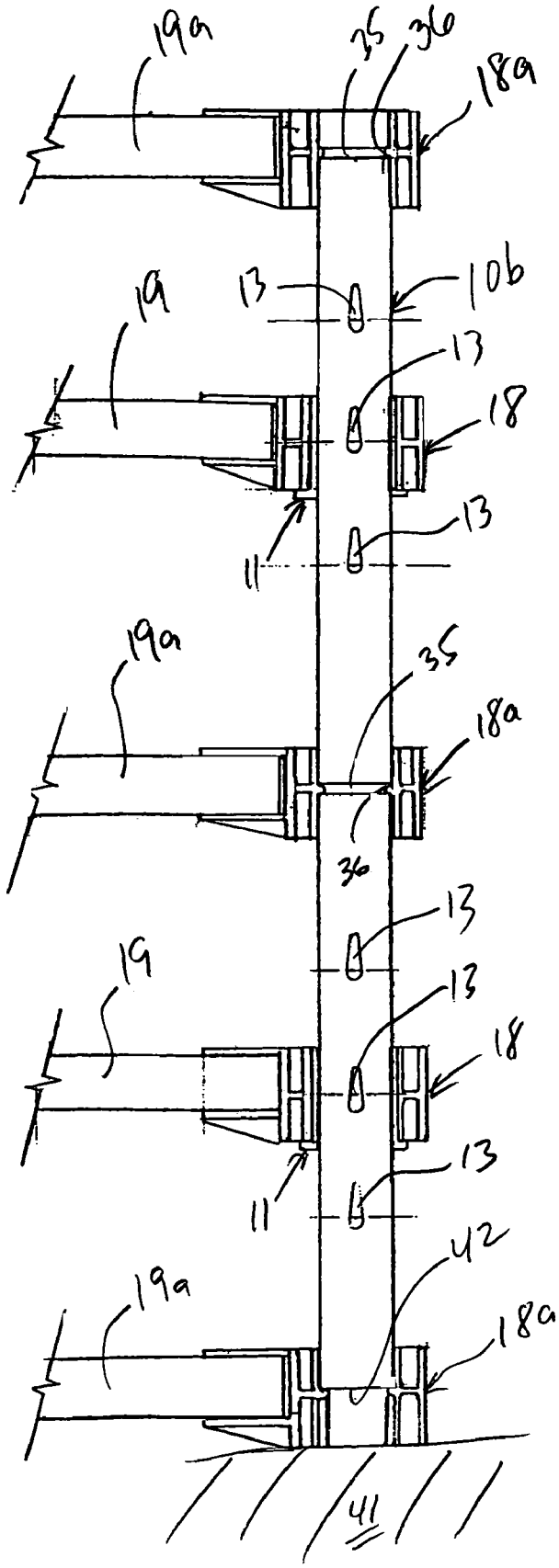
FIG. 6 is a partial plan and sectional view of a support post, two non-adjustable end caps and shelves and three adjustable collars, end caps and shelves of another embodiment of a disclosed adjustable shelving system.

Yet another variation is illustrated in FIG. 6. Non-adjustable shelves are shown at 19*a* while adjustable shelves are shown at 19. The upper most shelf 19*a* is supported by an end cap 18*a* which, in turn, is held in place via the circumferential groove 35 and rib 36 as discussed above in connection with FIG. 5. An identical arrangement is shown for the middle non-adjustable shelf 19*a*. However, the bottom non-adjustable shelf 19*a* is supported by an end cap 18*a* that rests on the ground 41 or is trapped between the ground 41 and the over hanging ledge 42 disposed in the support post 10*b*.

It will also be noted that the shelves 19, 19*a* may be secured in place in their respective end caps 18, 18*a* by a locking tab, pin, bolt, shaft or other fastening mechanism. Preferably, the collars 11 are fabricated from plastic or other sturdy, but pliable material. Some spring steels will be suitable.

Thus, an adjustable shelving system is disclosed whereby the vertical height of the shelves may be adjusted without resorting to hand tools or other similar devices. The slope of the inner walls 26 of the slots radially outward as they extend upward from the lower horizontal services 14 in combination with the slope of the inner surfaces 25 of the cleats 15 as they extend upward from the lower horizontal surfaces 27 of the cleats 15 in combination with the free ends 22, 23 and gaps 24 in the body 16 of the collar 11 enables the collar to be easily removed from any locked position and, upon slight rotation, further permits the collar to be slid upward or downward along the support post 10 to a new position. Easy downward movement of a collar 11 once its cleats 15 are positioned above corresponding slots, results in the collars 11 being easily locked back into place in a new position on the support posts 10.

While embodiments with four support posts are disclosed, this disclosure is also applicable to systems with one, two, three or more than four support posts.

What is claimed:

1. An adjustable shelving system comprising:

a cylindrical support post having at least two slots disposed on an outer surface thereof and spaced axially along the support post, each slot comprising a lower horizontal surface that extends through the outer surface of the support post a first depth, each slot extending upward from its lower horizontal surface and tapering outward to the outer surface of the support post so that an upper distal end of each slot is at least substantially flush with the outer surface of the support post;

a cylindrical collar having an outer surface, the outer surface having a substantially constant outer diameter along a length defined between a top and bottom edge thereof, which is slidably received over the support post; and an end cap that surrounds the collar, the end cap having an inner surface, the inner surface having a substantially constant inner diameter along a length defined between a top and bottom edge thereof;

wherein the collar extends around the support post and terminates in two free ends with a gap disposed therebetween, the collar includes an annular flange extending from an outer surface of the collar and a radially inwardly extending cleat extending from an inner surface of the collar, the cleat is received in one of the slots of the support post so that the cleat engages the lower horizontal surface of one of the slots, and the collar is movable along the support post by upward pressure on the collar to slide the cleat upwards off of the lower horizontal surface of the slot and past the distal end of the slot.

2. The shelving system of claim 1 wherein the cleat comprises a lower horizontal end that extends radially inwardly from the body of the collar a first distance less than or equal to the first depth of each lower horizontal surface of each slot.

3. The shelving system of claim 2 wherein the cleat further comprises an inner surface that extends upward from the lower horizontal surface of the cleat to an upper distal end that is at least substantially flush with the inner surface of the collar.

4. The shelving system of claim 1 wherein each slot further comprises an inner wall extending from the lower horizontal surface to the upper distal end of the slot, the inner wall being concave.

5. The shelving system of claim 4 wherein the cleat comprises a lower horizontal end that extends radially inwardly from the collar and an inner surface that extends upward from the lower horizontal surface of the cleat to an upper distal end that is at least substantially flush with the inner surface of the collar, the inner surface of the cleat being convex.

6. The shelving system of claim 1 wherein the end cap is supported by the annular flange.

7. The shelving system of claim 6 further comprising a shelf that is supported by the end cap.

8. The shelving system of claim 7 wherein the end cap comprises an annular body with a central opening received over the collar and a lower end that is supported by the annular flange, the body of the end cap being connected to a horizontal body with an opening for receiving the shelf.

9. The shelving system of claim 1 wherein the support post comprises at least two pairs of slots vertically spaced apart along the support post, each slot being disposed diametrically opposite the support post from the other slot of its respective pair, and the collar includes a pair of cleats, each cleat being disposed diametrically opposite the body of the collar from the other cleat.

10. The shelving system of claim 9 wherein each cleat comprises a lower horizontal end that extends radially inwardly from the collar a first distance less than or equal to the first depth of each lower horizontal surface of each slot.

11. The shelving system of claim 10 wherein each cleat further comprises an inner surface that extends upward from the lower horizontal surface of the cleat so that an upper distal end is at least substantially flush with the inner surface of the body of the collar.

12. The shelving system of claim 9 wherein each slot further comprises an inner wall extending from the lower horizontal surface to the upper distal end of the slot, the inner wall being concave.

13. The shelving system of claim 12 wherein each cleat comprises a lower horizontal end that extends radially inwardly from the body of the collar and an inner surface that extends upward from the lower horizontal surface of the cleat to an upper distal end that is at least substantially flush with the inner surface of the body of the collar, the inner surface of each cleat being convex.

14. The shelving system of claim 9 further comprising a shelf that is supported by the end cap.

15. The shelving system of claim 14 wherein the end cap comprises a annular body with a central opening received over the collar and a lower end that is supported by the flange, the body of the end cap being connected to a horizontal body with an opening for receiving the shelf.

16. An adjustable shelving system comprising:

four cylindrical support posts, each support post comprising at least two slots disposed on an outer surface thereof and spaced axially along the support post, and each slot comprising a lower horizontal surface that extends through the outer surface of the support post a first depth, each slot extending upward from its lower horizontal surface and tapering outward to the outer surface of the support post so that an upper distal end of each slot is at least substantially flush with the outer surface of the support post, four collars with one collar mounted on each support post, each collar comprising a cylindrical body having an outer surface, the outer surface having a substantially constant outer diameter along a length defined between a top and bottom edge thereof, which is slidably received over the support post; and an end cap that surrounds the body of each collar, the end cap having an inner surface, the inner surface having a substantially constant inner diameter along a length defined between a top and bottom edge thereof;

wherein each collar extends around its respective support post and terminates in two free ends with a gap disposed therebetween, the body of each collar includes an annular flange extending outward from an outer surface of the collar and a radially inwardly extending cleat extending from an inner surface of the collar, each cleat is received in one of the slots of its respective support post so that each cleat engages the lower horizontal surface of one of the slots its respective support posts, and each collar is movable along its respective support post by upward pressure on the collar to slide the cleat upwards off of the lower horizontal surface of the slot and past the distal end of the slot.

17. The shelving system of claim 16 wherein each cleat comprises a lower horizontal end that extends radially inwardly from the body of its respective collar a first distance less than or equal to the first depth of each lower horizontal surface of each slot.

18. The shelving system of claim 17 wherein each cleat further comprises an inner surface that extends upward from the lower horizontal surface of the cleat so that an upper distal end is at least substantially flush with the inner surface of the body of its respective collar.

19. The shelving system of claim 16 wherein each slot further comprises an inner wall extending from the lower horizontal surface to the upper distal end of the slot, the inner wall being concave.

20. The shelving system of claim 19 wherein each cleat comprises a lower horizontal end that extends radially inwardly from the body of its respective collar and an inner surface that extends upward from the lower horizontal surface of the cleat to an upper distal end that is at least substantially flush with the inner surface of the body of its respective collar, the inner surface of each cleat being convex.

21. The shelving system of claim 16 wherein each end cap is supported by the flange of its respective collar.

22. The shelving system of claim 21 further comprising a shelf that is supported by the end caps.

23. The shelving system of claim 22 wherein each end cap comprises a annular body with a central opening received over the body of its respective collar and a lower end that is supported by the flange of its respective collar, the body of each end cap being connected to a horizontal body with an opening for receiving the shelf.

24. The shelving system of claim 16 wherein each support post comprises at least two pairs of slots vertically spaced apart along the support post, each slot being disposed diametrically opposite the support post from the other slot of its respective pair, and each collar further comprising a pair of cleats, each cleat being disposed diametrically opposite the body of the collar from the other cleat.

25. A shelving system of claim 16 further comprising at least four additional fixed collars non-adjustably secured to the support post.

26. The shelving system of claim 25 further comprising a shelf fixably supported by the four additional fixed collars.

27. A method for adjusting the height of a shelf of an adjustable shelving system, the method comprising:

providing a shelving system comprising a cylindrical support post, the support post comprising at least two slots disposed on an outer surface thereof and spaced axially along the support post, and each slot comprising a lower horizontal surface that extends through the outer surface of the support post a first depth, each slot extending upward from its lower horizontal surface and tapering outward to the outer surface of the support post so that an upper distal end of each slot is at least substantially flush with the outer surface of the support post, a collar comprising a cylindrical body having an outer surface, the outer surface having a substantially constant outer diameter along a length defined between a top and bottom edge thereof, which is slidably received over the support post; and an end cap that surrounds the body of the collar, the end cap having an inner surface, the inner surface having a substantially constant inner diameter along a length defined between a top and bottom edge thereof;

wherein the collar extends around the support post and terminates in two free ends with a gap disposed therebetween, the body of the collar includes an annular flange extending from the outer surface of the collar and a radially inwardly extending cleat extending from an inner surface of the collar, the cleat of the collar is received in one of the slots of the support post so that the cleat engages the lower horizontal surface of one of the slots;

applying upward pressure to the collar to slide the cleat upwards off of the lower horizontal surface of said one of the slots and past the distal end of said slot;

rotating the collar around the support post less than 360°;

moving the collar vertically along the support post until the cleat of the collar is disposed vertically above the other slot of the support post;

rotating the collar until the cleat is in axial alignment with said other slot of the support post;

applying downward pressure on the collar until the cleat engages the lower horizontal surface of the said other slot.

28. The method of claim 27 wherein the end cap is supported by the flange of the collar, and a shelf is supported by the end cap, the method further comprising:

removing the shelf from engagement with the end cap and removing the end cap from engagement with the collar prior to applying upward pressure on the collar; and replacing the end cap over the collar and replacing the shelf on the end cap after applying downward pressure on the collar.

* * * * *

UNITED STATES PATENT AND TRADEMARK OFFICE

CERTIFICATE OF CORRECTION

PATENT NO. : 7,100,781 B2
APPLICATION NO. : 10/732431
DATED : September 5, 2006
INVENTOR(S) : Charles W. Craft It is certified that error appears in the above-identified patent and that said Letters Patent is hereby corrected as shown below:

In the Claims:

At Column 6, line 56, “a annular” should be -- an annular --.

At Column 7, lines 5-6, please close up the break to continue the same paragraph.

At Column 7, line 55, “a annular” should be -- an annular --.

Signed and Sealed this

Twenty-ninth Day of May, 2007

JON W. DUDAS
*Director of the United States Patent and Trademark Office*